US010689787B2

(12) United States Patent
Nishino

(10) Patent No.: US 10,689,787 B2
(45) Date of Patent: Jun. 23, 2020

(54) WASHING MACHINE AND METHOD FOR CONTROLLING THE SAME

(71) Applicants: QINGDAO HAIER WASHING MACHINE CO., LTD., Qingdao, Shandong (CN); AQUA CO., LTD, Chiyoda-ku, Tokyo (JP)

(72) Inventor: Masafumi Nishino, Tokyo (JP)

(73) Assignees: Qingdao Haier Washing Machine Co., Ltd., Shandong (CN); Aqua Co., Ltd., Tokyo (JP)

( * ) Notice: Subject to any disclaimer, the term of this patent is extended or adjusted under 35 U.S.C. 154(b) by 270 days.

(21) Appl. No.: 15/760,987

(22) PCT Filed: Sep. 18, 2016

(86) PCT No.: PCT/CN2016/099256
§ 371 (c)(1),
(2) Date: Mar. 16, 2018

(87) PCT Pub. No.: WO2017/045649
PCT Pub. Date: Mar. 23, 2017

(65) Prior Publication Data

US 2018/0258571 A1 Sep. 13, 2018

(30) Foreign Application Priority Data

Sep. 17, 2015 (JP) ..... 2015-184111

(51) Int. Cl.
*D06F 37/24* (2006.01)
*D06F 23/04* (2006.01)
(Continued)

(52) U.S. Cl.
CPC ..... *D06F 37/245* (2013.01); *D06F 23/04* (2013.01); *D06F 37/12* (2013.01); *D06F 37/203* (2013.01);
(Continued)

(58) Field of Classification Search
CPC ..... D06F 37/245; D06F 37/12; D06F 37/203; D06F 23/04; D06F 2202/08; D06F 2204/08; D06F 2212/02
(Continued)

(56) References Cited

U.S. PATENT DOCUMENTS 5,761,933 A 6/1998 Kim et al.
2015/0233040 A1* 8/2015 Kim ..... D06F 37/225 68/140

FOREIGN PATENT DOCUMENTS

CN 1138118 A 12/1996
CN 114578 A 4/1997
(Continued)

OTHER PUBLICATIONS

JP2015043866A—Machine translation (Year: 2015).*
(Continued)

*Primary Examiner* — Tinsae B Ayalew
(74) *Attorney, Agent, or Firm* — Arent Fox LLP

(57) ABSTRACT

A washing machine is provided. The washing machine includes a dewatering tub having an impeller provided at a bottom thereof; three or more baffles arranged at equal intervals in a circumferential direction with respect to an inner circumferential surface of the dewatering tub, which are opened in the vicinity of the bottom and in which a water circulation opening is formed at the upper end; a water receiving ring unit fixed to an upper end of the dewatering tub and formed by stacking a plurality of annular water guiding grooves, which are connected to the upper end of the respective baffles via communication members; and a nozzle unit capable of individually injecting adjusting water into each of the water guiding grooves.

4 Claims, 9 Drawing Sheets

(51) Int. Cl.
*D06F 37/12* (2006.01)
*D06F 37/20* (2006.01)

(52) U.S. Cl.
CPC ..... *D06F 2202/08* (2013.01); *D06F 2204/08* (2013.01); *D06F 2212/02* (2013.01)

(58) Field of Classification Search
USPC ..... 68/23.2
See application file for complete search history.

(56) References Cited

FOREIGN PATENT DOCUMENTS

| | | | |
|---|---|---|---|
| CN | 203923694 | U | 11/2014 |
| GB | 819168 | A | 8/1959 |
| JP | S4613439 | Y | 5/1971 |
| JP | S48084473 | A | 11/1973 |
| JP | H07308487 | A | 11/1995 |
| JP | 9-290089 | A | 11/1997 |
| JP | 9308794 | A | 12/1997 |
| JP | H11169595 | A | 6/1999 |
| JP | 2002-346287 | A | 12/2002 |
| JP | 2009463 | A | 1/2009 |
| JP | 2011-131095 | A | 7/2011 |
| JP | 05650927 | B2 | 1/2015 |
| JP | 2015043866 | A | 3/2015 |
| WO | 2015126140 | A1 | 8/2015 |

OTHER PUBLICATIONS

Extended European Search Report for EP application 16845763.8-1018 dated Mar. 7, 2019.
Japanese language Office Action and its English language translation for JP application 2015-184111 dated Jun. 24, 2019.
International Search Report and Written Opinion for PCT/CN2016/099256 dated Dec. 5, 2016.

* cited by examiner

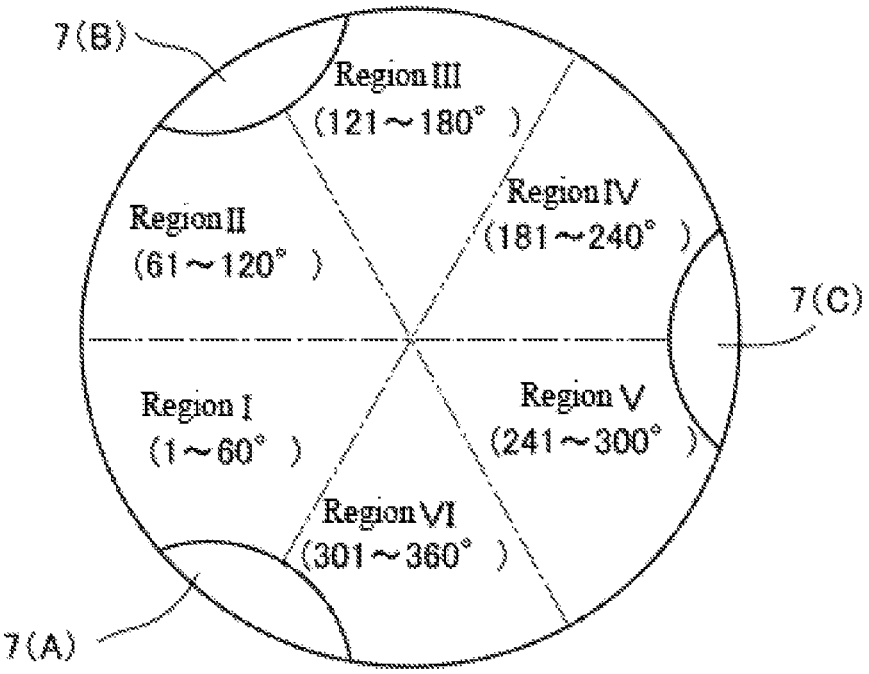

| N | Water supply valve X | Region Y | Water supply valve Z |
|---|---|---|---|
| Region I | Water supply valve 26c | Region V | Water supply valve 26b |
| Region II | Water supply valve 26c | Region IV | Water supply valve 26a |
| Region III | Water supply valve 26a | Region I | Water supply valve 26c |
| Region IV | Water supply valve 26a | Region VI | Water supply valve 26b |
| Region V | Water supply valve 26b | Region III | Water supply valve 26a |
| Region VI | Water supply valve 26b | Region II | Water supply valve 26c |

FIG. 9

WASHING MACHINE AND METHOD FOR CONTROLLING THE SAME

TECHNICAL FIELD

The present application relates to a washing machine and a method for controlling the washing machine capable of eliminating the unbalance of a dewatering tub and suppressing vibrations and noises caused due to eccentricity of the dewatering tub at the time of dewatering while keeping the rotation of the dewatering tub.

BACKGROUND

For a general washing machine installed in a common home or a laundromat, the laundry will be biased in a dewatering tub during dewatering, causing vibrations and noises. Depending on the location of the washing machine and the surrounding environment thereof, troubles may occur due to the vibrations and the noises. In addition, when the laundry is greatly biased during the dewatering, the eccentricity of the dewatering tub during the rotation becomes greater, and thus a large torque is required for the rotation. Accordingly, the dewatering operation cannot be started.

In view of the above, the following first technique may be employed: an unbalance amount and an unbalance position of the laundry inside the washing tub are detected during the dewatering; when there is imbalance, the washing tub is braked to stop rotating to reduce the centrifugal force so that a mass of laundry causing the imbalance drops and is dispersed by gravity.

In addition, the following second technique may be employed: it is determined whether there is imbalance in the washing/dewatering tub during a low-speed rotation; when the imbalance is detected, to eliminate the imbalance, the motor is stopped, and water is injected to the washing/dewatering tub to release the mass of laundry.

However, for the first technique, unbalance detection and dispersion operation are performed only when the dewatering tub is rotated at a low speed, and there is a possibility that the unbalance may occur again due to factors such as the type of the laundry after a high speed rotation of the dewatering tub is started.

Moreover, for the first and second techniques, since the rotation of the dewatering tub is decelerated or stopped when the imbalance is detected, a start-up power is required every time the dewatering operation is repeated, causing an increase in power consumption. Furthermore, with the second technique, in addition to the increase in power consumption, a problem that the amount of water used increases exists.

SUMMARY

The present disclosure aims to effectively solve such a problem and provide a washing machine and a method for controlling the same. Through the washing machine and the method for controlling the same, the upsizing and complication of the apparatus can be effectively suppressed by utilizing the structure of the existing washing machine, and the unbalance of the dewatering tub can be eliminated without decelerating or stopping the rotation even if the laundry is biased in the dewatering tub during a dewatering operation. Therefore, the vibrations and the noises caused due to eccentricity of the dewatering tub are suppressed.

The present disclosure has been made in view of the above problem.

The washing machine according to the present disclosure includes: a dewatering tub, which has an impeller arranged at a bottom thereof; three or more water pipe sections, which are arranged at equal intervals in a circumferential direction with respect to an inner circumferential surface of the dewatering tub, and are opened in the vicinity of the bottom, a water circulation opening is formed at the upper end of each of the water pipe sections; a water receiving ring unit, which is fixed to the upper end of the dewatering tub and formed by stacking a plurality of annular water guiding grooves, which are connected to the upper end of the respective water pipe sections via a communication member; and a nozzle unit capable of individually injecting adjusting water into each of the water guiding grooves.

Particularly, it is preferable, that the communication member is connected to a position above the water circulation opening, and each of the water pipe sections is provided with a spacer extending from a position to which the communication member is connected and the water circulation opening to a position close to the inner circumferential surface of the dewatering tub.

Further, preferably, the water receiving ring unit is provided at the inner circumferential surface of the dewatering tub, and is formed by stacking the plurality of water guiding grooves in a radial direction of the dewatering tub.

Alternatively, preferably, the water receiving ring unit is provided at the inner circumferential surface of the dewatering tub, and is formed by stacking the plurality of water guiding grooves in an up-down direction.

Further, the present disclosure relates to a method for controlling the washing machine. During a dewatering process, the adjusting water is injected into any of the water guiding grooves of the water receiving ring unit from the nozzle unit, and is supplied to the water pipe sections via the communication member.

According to the present disclosure explained above, during the washing process, the washing water is stirred upward by the impeller, enters the opening near the bottom and passes through the water pipe sections to be discharged from the water circulation opening. Therefore, through the washing water circulated inside the dewatering tub, the laundry is rinsed in the same manner as the conventional washing machine. In addition, in the dewatering process, the adjusting water can be individually injected into any of the water receiving ring units that rotate integrally with the dewatering tub from the nozzle unit, so as to supply the adjusting water to the water pipe sections via the communication members, and by means of the centrifugal force, the adjusting water is stuck to the inner circumferential surface of the dewatering tub to be left inside the water pipe sections to adjust the weight of the water pipe sections. Therefore, by keeping the adjusting water in the water pipe section on the side opposite to the part, where the clothes are biased, with respect to the axis of the dewatering tub during the dewatering driving, it is possible to eliminate the imbalance of the dewatering tub caused by the bias of the laundry without slowing or stopping the rotation of the dewatering tub halfway. Therefore, the present disclosure can efficiently suppress upsizing and complication of the apparatus by utilizing the structure of the existing washing machine, and even if the laundry is biased in the dewatering tub during a dewatering operation, the imbalance of the dewatering tub can be eliminated while the dewatering tub continues to rotate, and the vibrations (vibrations occurring during the dewatering operation) and the noises that are generated by the biasing of the dewatering tub can be inhibited.

In particular, according to the present disclosure having the spacer, the washing water stirred upward by the impeller is guided through the spacer during the washing process so as to be discharged from the water circulation opening properly. In addition, during the dewatering process, the adjusting water supplied via the water receiving ring unit is supplied stably from the gap between the spacer and the inner circumferential surface of the dewatering tub to the lower portion of the water pipe sections.

Further, according to the present disclosure in which a plurality of water guiding grooves are stacked in a radial direction of the dewatering tub, all the water guiding grooves are opened upward, and the water can be individually injected from the nozzle unit to each of the water guiding grooves.

Alternatively, according to the present disclosure in which the plurality of water guiding grooves are vertically stacked, the lateral width of the water receiving ring unit can be reduced, and the opening of the dewatering tub can be widened.

In addition, according to the present disclosure that is controlled by supplying the adjusting water to the water pipe sections during the dewatering process, even if the laundry is biased inside the dewatering tub during the dewatering operation, it is possible to eliminate the imbalance of the dewatering tub in a state where the normal dewatering operation continues, and suppress the vibrations and the noises caused by the centrifugation of the dewatering tub without slowing or stopping the rotation of the dewatering tub halfway.

BRIEF DESCRIPTION OF DRAWINGS

FIG. 9 is a diagram for explaining the control flow during the dewatering process of the washing machine.

A LIST OF REFERENCE NUMERALS

1: Washing machine; 2: Dewatering tub; **2*a*1: Inner circumferential surface of the dewatering tub; 2*c*: Bottom; 4: Impeller; 5: Water receiving ring unit; 5*a*, 5*b*, 5*c*: Water guiding groove; 5*a*1, 5*b*1 and 5*c*1: Communication member; 6: Nozzle unit; 7: Baffle (water pipe section); 7*a*: Spacer; 70: Water circulation opening; 71**: Opening (opening)

DETAILED DESCRIPTION

Hereinafter, an embodiment of the present disclosure will be described in detail in accompanying with the drawings.

Figure 1:
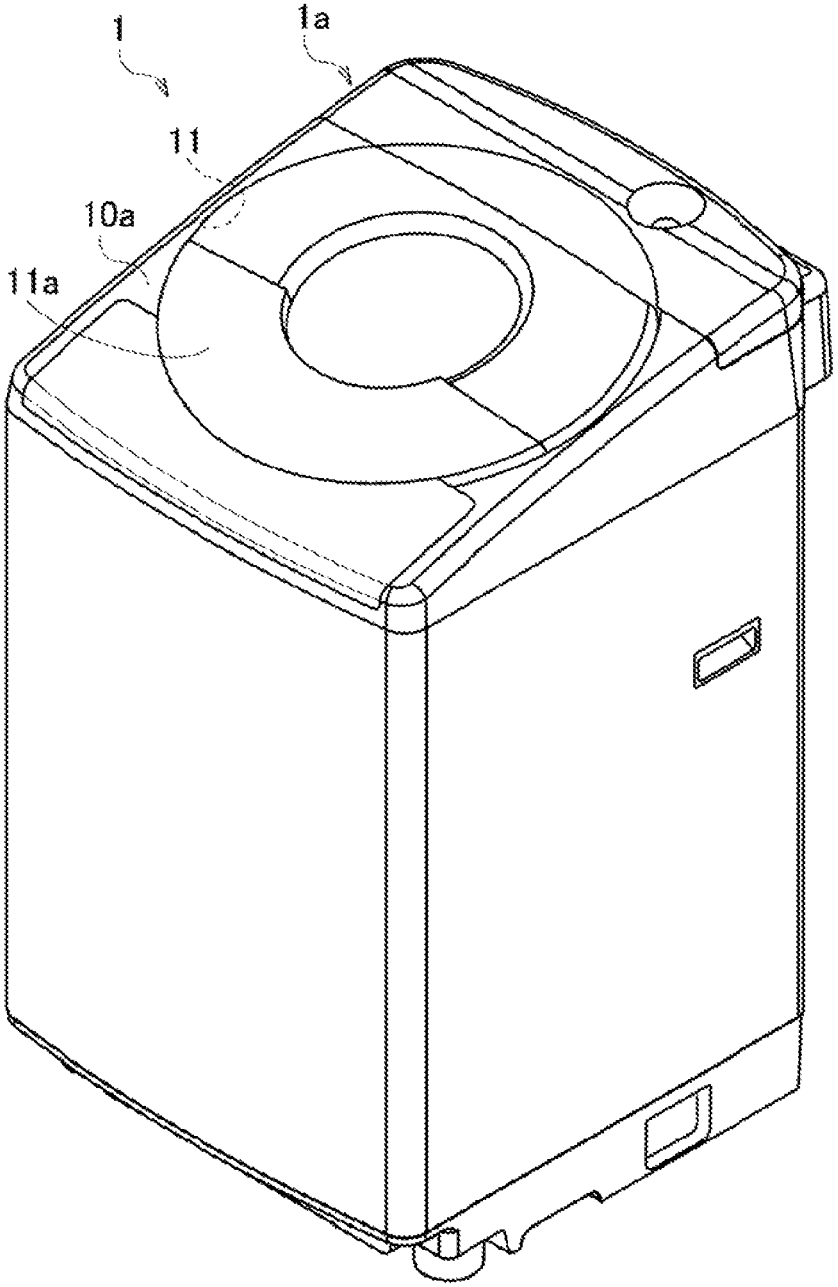
FIG. 1 is a perspective view showing an appearance of a washing machine according to an embodiment of the present disclosure.
Figure 2:
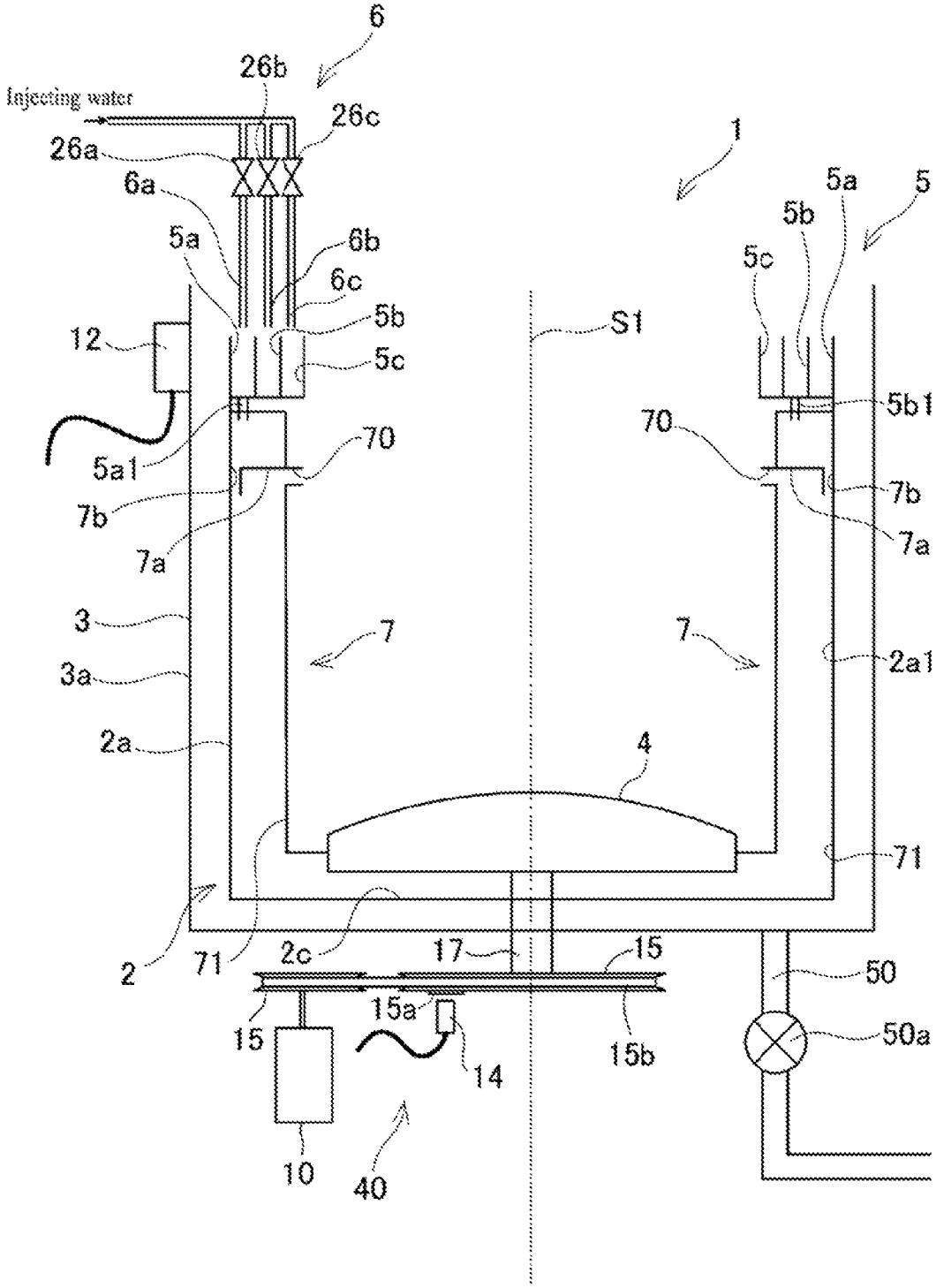
FIG. 2 is a schematic view showing a structure of the washing machine.
Figure 3:
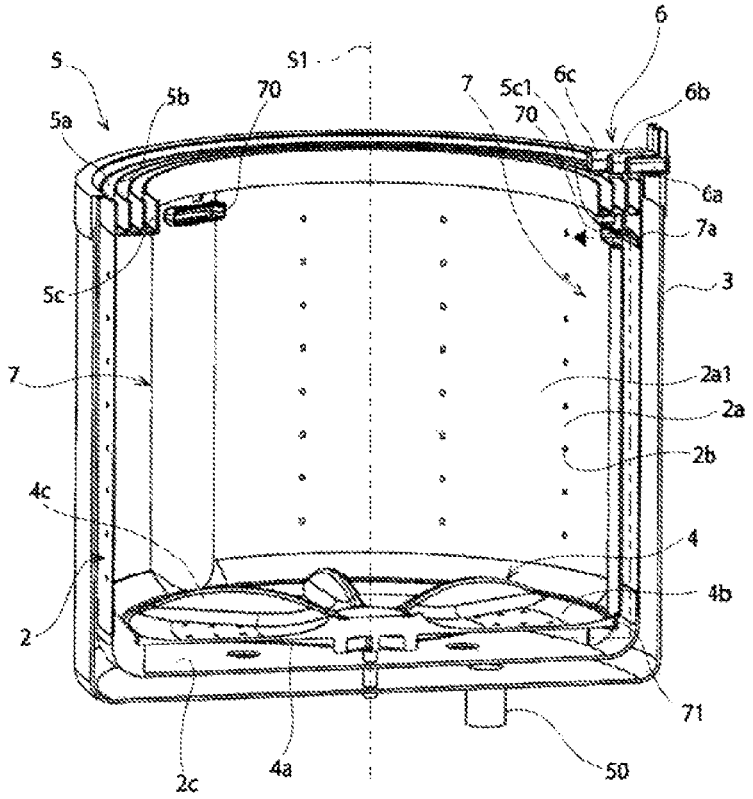
FIG. 3 is a partial longitudinal sectional perspective view of the washing machine.
Figure 4:
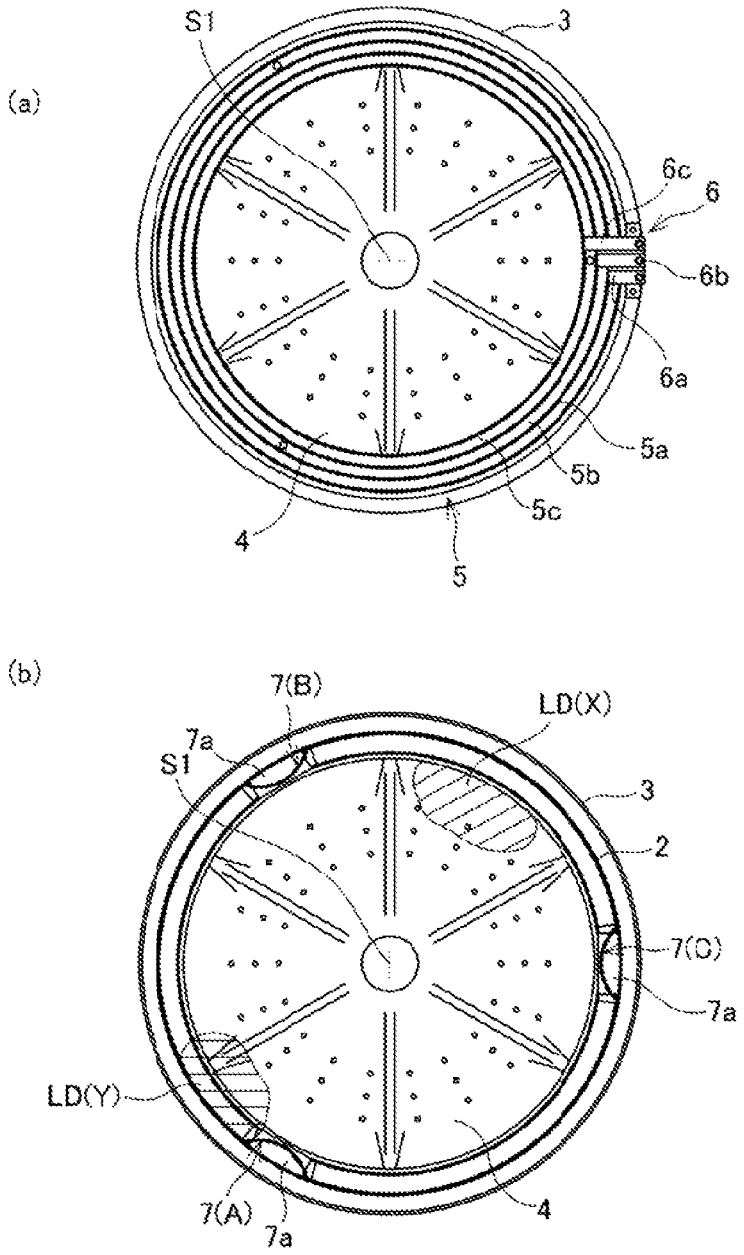
FIG. 4 is a view showing a part of the washing machine viewed from above.
Figure 5:
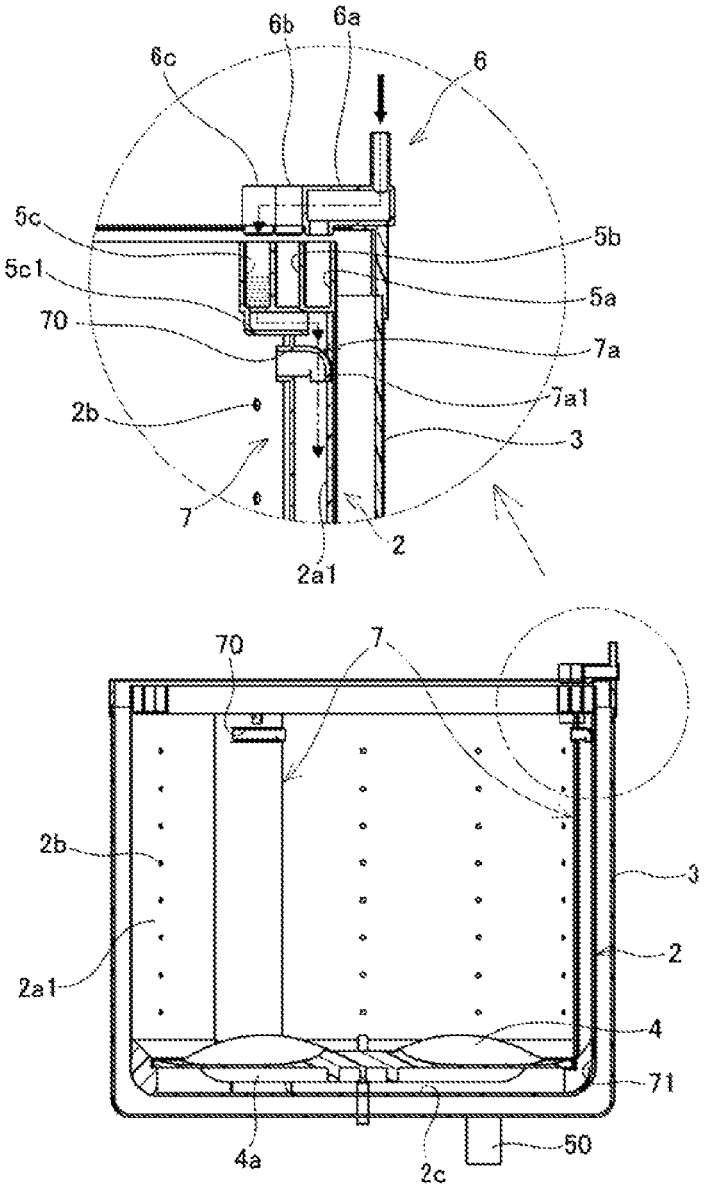
FIG. 5 is a partial longitudinal sectional view of the washing machine.

FIG. 1 is a perspective view showing an appearance of a vertical type washing machine 1 (hereinafter, it is referred to as "a washing machine") according to an embodiment of the present disclosure. FIG. 2 is a schematic view showing a structure of the washing machine 1 according to the embodiment. FIG. 3 is a partial longitudinal sectional perspective view of the washing machine 1 according to the embodiment. FIG. 4 is a view showing a part of the washing machine 1 according to the embodiment when viewed from above. FIG. 4(*a*) is a top view, and FIG. 4(*b*) is a cross-sectional view of a dewatering tub 2 of the washing machine 1. FIG. 5 is a partial longitudinal sectional view of the washing machine 1 according to the embodiment.

Figure 6:
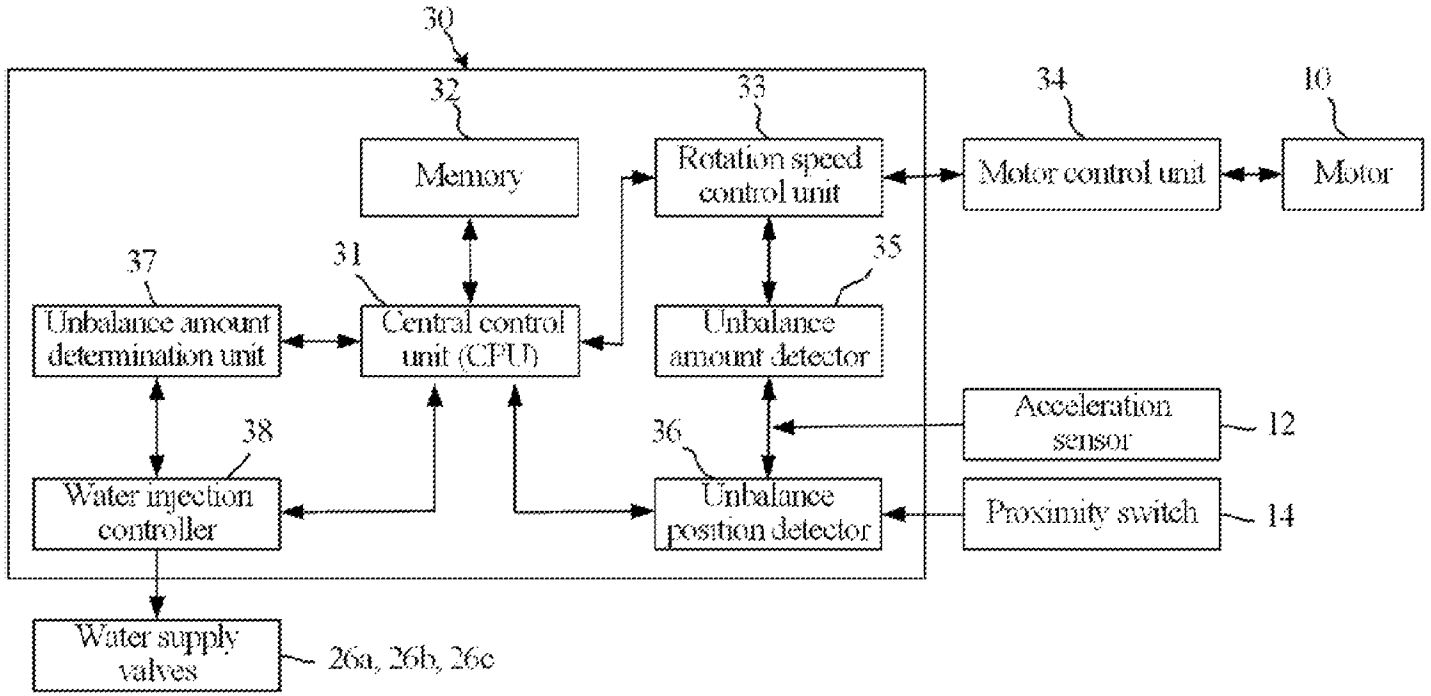
FIG. 6 is a block diagram of an electrical system of the washing machine.

The washing machine 1 according to the embodiment includes a washing machine main body **1*a*, an outer tub 3, a dewatering tub 2, a water receiving ring unit 5, a nozzle unit 6, a driving unit 40 and a control unit (see FIG. 6**).

The washing machine main body **1*a* shown in FIG. 1 has a substantially cuboid shape. An upper surface 10*a* of the washing machine main body 1*a* is formed with an opening 11 for placing laundry into/taking the laundry out of the outer tub 2, and an opening/closing lid 11*a* for opening or closing the opening 11**.

The outer tub 3 is a cylindrical member with a bottom, which is provided inside the washing machine main body **1*a* and is capable of storing washing water therein. As shown in FIG. 2, an acceleration sensor 12 for detecting accelerations in both the horizontal and vertical directions is mounted on an outer peripheral surface 3*a* of the outer tub 3**.

The dewatering tub 2 is a cylindrical member with a bottom, which is disposed within the outer tub 3 and is coaxially with the outer tub 3. The dewatering tub 2 is supported so that the dewatering tub 2 rotates within the outer tub 3. The dewatering tub 2 accommodates the laundry therein, and a wall surface **2*a* thereof has a plurality of water-passing holes 2*b* (see FIG. 3**).

An impeller (stirring blade) 4 is rotatably disposed at the center of a bottom **2*c* of the dewatering tub 2. As shown in FIG. 3, the impeller 4 has a substantially disk-shaped impeller main body 4*b*, a plurality of upper blades 4*c* formed on the upper surface of the impeller main body 4*b*, and a plurality of lower blades 4*a* formed on the lower surface of the impeller main body 4*b*. Such an impeller 4 is used to stir the washing water stored in the outer tub 3** to generate a water flow.

As shown in FIGS. 3 and 4 (*b*), on the inner peripheral surface **2*a*1 of the dewatering tub 2, three baffles (water injection pipes) 7 are provided as water pipe sections at equal intervals (at equal angles) in the circumferential direction. Each of the baffles 7 is formed to extend vertically from the bottom 2*c* of the dewatering tub 2 to the upper end thereof, and project from the inner peripheral surface 2*a*1 of the dewatering tub 2 toward axis S1. In addition, each of the baffles 7 is hollow, and has an arc cross section. In this manner, each of the baffles 7 has a shape that the baffle slightly protrudes to the axis S1 of the dewatering tub 2 and spreads along the circumferential direction of the dewatering tub 2, thereby preventing the storage space of the dewatering tub 2** from being narrowed.

As shown in FIGS. 2~3, an opening 71 is formed at the lower end of such a baffle 7. The opening 71 is opened in the vicinity of the bottom **2*c* of the dewatering tub 2, more specifically, below the impeller main body 4*b*. In addition, a horizontally elongated water circulation opening 70 is formed at the upper end of each baffle 7. Therefore, during the washing process in a state where a drain valve 50*a* (see FIG. 2) is closed and the washing water is accumulated in the outer tub 3, the washing water stirred by the lower blade 4***a* of the impeller 4 enters from the opening 71, ascends in the baffles 7, and is discharged from the water circulation opening 70 to rinse the laundry, as shown by an arrow in FIG. 3. In addition, the washing water is circulated in the dewatering tub 2 by repeating this action. That is, each of the baffles 7 is configured to circulate the washing water. It should be noted that the water pipe section described above which has the opening 71 and the water circulation opening 70 and can rinse the laundry is also applicable to the conventional washing machine. However, in the conventional washing machine, only one water pipe section is provided.

Further, a spacer 7*a* is formed inside each baffle 7. The spacer 7*a* extends from a position to which the communication members 5*a*1, 5*b*1 and 5*c*1 (described later) are connected and the water circulation opening 70 to a position close to the inner peripheral surface 2*a*1 of the dewatering tub 2. The spacer 7*a* extends from the upper end edge of the water circulation opening 70, and a free end 7*a*1 side thereof is bent downward. A gap 7*b* (see FIG. 2) is formed between the free end 7*a*1 of the spacer 7*a* and the inner peripheral surface 2*a*1 of the dewatering tub 2, and adjusting water (described later) supplied from the water receiving ring unit 5 flows downward through the gap 7*b*.

The water receiving ring unit 5 is a member formed by stacking annular water guiding grooves 5*a*, 5*b*, 5*c*, which are opened upward, as three layers in the radial direction toward the axis S1 of the dewatering tub 2 (see FIG. 4 (*a*)). As shown in FIG. 3, the water receiving ring unit 5 is fixed to the upper end of the inner peripheral surface 2*a*1 of the dewatering tub 2. The number of the water guiding grooves 5*a*, 5*b*, and 5*c* is set to be the same as that of the baffles 7, and a water passage for allowing the adjusting water to flow to any one of the baffles 7 is formed inside the water guiding grooves 5*a*, 5*b* and 5*c*. Such a water receiving ring unit 5 has substantially the same size and shape as those of a known liquid balancer attached to a conventional washing machine. In the present embodiment, the water receiving ring unit is installed at a mounting position of a conventional liquid balancer to replace the liquid balancer. The liquid balancer has a function of passively eliminating the unbalance of the dewatering tub 2 during the dewatering. However, as described later, compared with the water receiving ring unit 5 which can actively eliminate the unbalance of the dewatering tub 2, the liquid balancer has less effect.

The water receiving ring unit 5 is connected to the upper end of the baffles 7 through the communication members 5*a*1, 5*b*1 and 5*c*1 respectively. The communication members 5*a*1, 5*b*1 and 5*c*1 are connected to the baffles 7 at a position above the water circulation opening 70.

The nozzle unit 6 is a unit for injecting adjusting water into the water guiding grooves 5*a*, 5*b* and 5*c* individually. The nozzle unit 6 includes three water injection nozzles 6*a*, 6*b* and 6*c* arranged above the water guiding grooves 5*a*, 5*b* and 5*c*, and water supply valves 26*a*, 26*b* and 26*c* connected to the water injection nozzles 6*a*, 6*b* and 6*c* respectively. The number of the water injection nozzles 6*a*, 6*b* and 6*c* is set to be the same as the number of the water guiding grooves 5*a*, 5*b* and 5*c*, and the water injection nozzles are arranged at positions where water can be injected into respective water guiding grooves 5*a*, 5*b* and 5*c*. It should be note that, in the present embodiment, the tap water may be used as the adjusting water. In addition, a reversing water supply valve may also be employed as the water supply valves 26*a*, 26*b* and 26*c*.

When such a configuration is adopted, during the dewatering process in which the drain valve 50*a* is opened and the washing water in the outer tub 3 is discharged from the drain port 50, the adjusting water injected into the water guiding grooves 5*a*, 5*b* and 5*c* of the water receiving ring unit 5 from any one of the water injection nozzles 6*a*, 6*b* and 6*c* of the nozzle unit 6 flows into the baffle 7. For example, in the case that the adjusting water is injected from the injection nozzle 6*c*, the adjusting water flows into the baffle 7 from the water guiding groove 5*c* through the communication member 5*c*1, as indicated by an arrow in FIG. 5. When the dewatering tub 2 is in a high-speed rotation state, the adjusting water flowing into the baffles 7 is retained by the centrifugal force against the inner peripheral surface 2*a*1 of the dewatering tub 2. As a result, the weight of the baffles 7 increases, and the balance of the dewatering tub 2 is changed. In this way, each of the baffles 7 has a pocket baffle structure capable of storing the adjusting water through the centrifugal force. When the dewatering process is nearly completed and the rotational speed of the dewatering tub 2 is reduced, the centrifugal force in the baffles 7 gradually attenuates so that the adjusting water flows out of the opening 71 by gravity and is discharged to the outside of the outer tub 3 through the drain port 50. At this time, the adjusting water flows into the lower portion of the impeller main body 4*b* through the opening 71. Therefore, the adjusting water is discharged without wetting the clothes located above the impeller main body 4*b*.

The driving unit 40 shown in FIG. 2 is configured to cause pulleys 15, 15 and a transmission belt 15*b* to rotate by a motor 10, so as to cause a driving shaft 17 protruding toward the bottom 2*c* of the dewatering tub 2 to rotate. Accordingly, a driving force is applied to the dewatering tub 2 and the impeller 4 to make them rotate. In the washing machine 1, only the impeller 4 is caused to rotate during the washing process, while the dewatering tub 2 and the impeller 4 are caused to rotate integrally at a high speed during the dewatering process. In addition, a proximity switch 14 is provided in the vicinity of one of the pulleys 15. The proximity switch 14 is configured to detect passing of a mark 15*a* formed on the pulley 15.

As described above, the washing machine 1 according to the present embodiment includes a dewatering tub 2 having an impeller 4 arranged at a bottom 2*c* thereof; three or more baffles 7 served as water pipe sections, the baffles are arranged on an inner circumferential surface 2*a*1 of the dewatering tub 2 at equal intervals along the circumferential direction of the inner circumferential surface 2*a*1, and are opened in the vicinity of the bottom 2*c* and formed with a water circulation opening 70 at the upper end thereof; a water receiving ring unit 5 fixed to the upper end of the dewatering tub 2 and formed by stacking a plurality of annular water guiding grooves 5*a*, 5*b* and 5*c*, the annular water guiding grooves 5*a*, 5*b* and 5*c* are connected to the upper end of each of the baffles 7 via communication members 5*a*1, 5*b*1 and 5*c*1 respectively; and a nozzle unit 6 for injecting adjusting water into each of the water guiding grooves 5*a*, 5*b* and 5*c* individually.

When such a configuration is adopted, during the washing process, the washing water is stirred upward by the lower blade 4*a* of the impeller 4, enters from the opening 71, passes through the baffles 7, and is discharged from the water circulation opening 70. Accordingly, the laundry is rinsed by the washing water circulating in the dewatering tub 2. In addition, during the dewatering process, the adjusting water is injected into any one of the water guiding grooves 5*a*, 5*b* and 5*c* of the water receiving ring unit 5, which rotates integrally with the dewatering tub 2, from the nozzle unit 6 individually, and then supplied to the baffles 7 via the communication members 5*a*1, 5*b*1 and 5*c*1, and is retained in the baffles 7 by the centrifugal force against the inner peripheral surface 2*a*1 of the dewatering tub 2. Therefore, the weight of the baffles 7 can be adjusted. Please note that, the adjusting water in the baffles 7 is discharged from the opening 71 as the lower opening of the baffles 7 at the end of the dewatering process when the centrifugal force is reduced. Therefore, during the dewatering driving, by keeping the adjusting water in the baffle 7 on the side opposite to a position, where the laundry is biased, with respect to the axis S1 of the dewatering tub 2, it is possible to eliminate the imbalance of the dewatering tub 2 caused by the bias of the laundry without slowing or stopping the rotation of the dewatering tub 2 halfway. In this way, the upsizing and complication of the apparatus can be suppressed by utilizing the known structure for rinsing in the present disclosure, and even if the laundry is biased in the dewatering tub during a dewatering operation, the imbalance of the dewatering tub 2 can be eliminated in a state where the dewatering tub 2 continues to rotate. Therefore, the vibrations and the noises caused by the biasing of the dewatering tub 2 can be inhibited. In addition, troubles generated due to vibrations and noises are prevented in the placement of the washing machine 1 and the surrounding environment thereof.

Moreover, as described above, the communication members 5*a*1, 5*b*1 and 5*c*1 are connected above the water circulation opening 70, and each of the baffles 7 has the spacer 7*a* extending from a space between the positions, to which c the 5*a*1, 5*b*1 and 5*c*1 are connected, and the water circulation opening 70 to a position close to the inner peripheral surface 2*a*1 of the dewatering tub 2. Therefore, during the washing process, the washing water stirred upward by the impeller 4 is prevented from entering the communication members 5*a*1, 5*b*1, 5*c*1 and the water guiding grooves 5*a*, 5*b*, 5*c*, and the washing water is guided by the spacer 7*a* so that it can be properly discharged from the water circulation opening 70. In addition, during the dewatering process, the adjusting water supplied from the water receiving ring unit 5 stably flows into each of the baffles 7 through the gap 7*b* between the spacer 7*a* and the inner peripheral surface 2*a*1 of the dewatering tub 2.

Further, as described above, the water receiving ring unit 5 is disposed on the inner peripheral surface 2*a*1 of the dewatering tub 2. The water receiving ring unit 5 is formed by stacking the plurality of water guiding grooves 5*a*, 5*b* and 5*c* in the radial direction of the dewatering tub 2, so that the water guiding grooves 5*a*, 5*b* and 5*c* are opened upward to easily receive water separately injected into each of the water guiding grooves 5*a*, 5*b* and 5*c* from the nozzle unit 6.

FIG. 6 is a block diagram showing the electrical configuration of the washing machine 1 according to the present embodiment. The operation of the washing machine 1 is controlled by a control unit 30 including a microcomputer. The control unit 30 includes a central control unit (CPU) 31 for controlling the overall system. The CPU 31 is connected to a memory 32 for storing the following values necessary for the rotation control of the dewatering tub 2: a low speed rotation setting value (N1) before the dewatering operation is started; a high-speed rotation setting value (N2) after the dewatering operation is started; an imbalance amount setting value (ma) during the low-speed dewatering operation and an imbalance amount setting value (mb) during the high-speed dewatering operation. Further, through the control unit 30, programs stored in the memory 32 are executed by a microcomputer to carry out a preset operation. Moreover, data and the like used for executing the programs are temporarily stored in the memory 32.

The central control unit 31 is configured to output a control signal to a rotation speed control unit 33. The control signal is further output to a motor control unit (motor control circuit) 34 to control the rotation of the motor 10. It should be noted that the rotation speed control unit 33 receives a signal indicating the rotation speed of the motor 10 from the motor control unit 34 in real time, and the signal is used as a control element. An acceleration sensor 12 is connected to an unbalance amount detector 35, and the acceleration sensor 12 and the proximity switch 14 are connected to an unbalance position detector 36.

Accordingly, when the mark 15*a* (see FIG. 2) is detected by the proximity switch 14, an unbalance amount (M) is calculated by the unbalance amount detector 35 based on the magnitudes of the accelerations in the horizontal and vertical directions from the acceleration sensor 12, and the unbalance amount is output to an unbalance amount determination unit 37. On the other hand, the unbalance position detector 36 calculates an angle in the unbalance direction based on a signal indicating the position of the mark 15*a* input from the proximity switch 14, and a signal indication the unbalance position is output to a water injection controller 38.

When a signal indicating the unbalance amount and the unbalance position from the unbalance amount determination unit 37 and the unbalance position detector 36 is input, the water injection controller 38 determines whether to supply water to any one of the baffle 7 in the dewatering tubs 2 and determines the supplying amount thereof based on the control programs stored in advance. Then, the selected water supply valves 26*a*, 26*b* and 26*c* are opened to inject the adjusting water. When the dewatering tub 2 is unbalanced, the adjusting water is injected into the water guiding grooves 5*a*, 5*b* and 5*c* of the water receiving ring unit 5 from the water supply nozzles 6*a*, 6*b* and 6*c* selected based on the calculation of the unbalance amount. When the imbalance is eliminated by the baffles 7, the injection of the adjusting water is stopped.

It should be noted that, for example, as shown in FIG. 4(*b*), when the mass of laundry LD (X) constituting the main factor of the imbalance is located between the baffle 7(B) and the baffle 7(C) of the dewatering tub 2, the water injection controller 38 performs control to supply the adjusting water to the baffle 7(A). In addition, when the mass of laundry LD (Y) is in the vicinity of the baffle 7(A), the water injection controller 38 performs control to supply the adjusting water to both of the baffle 7(B) and the baffle 7(C).

Figure 7:
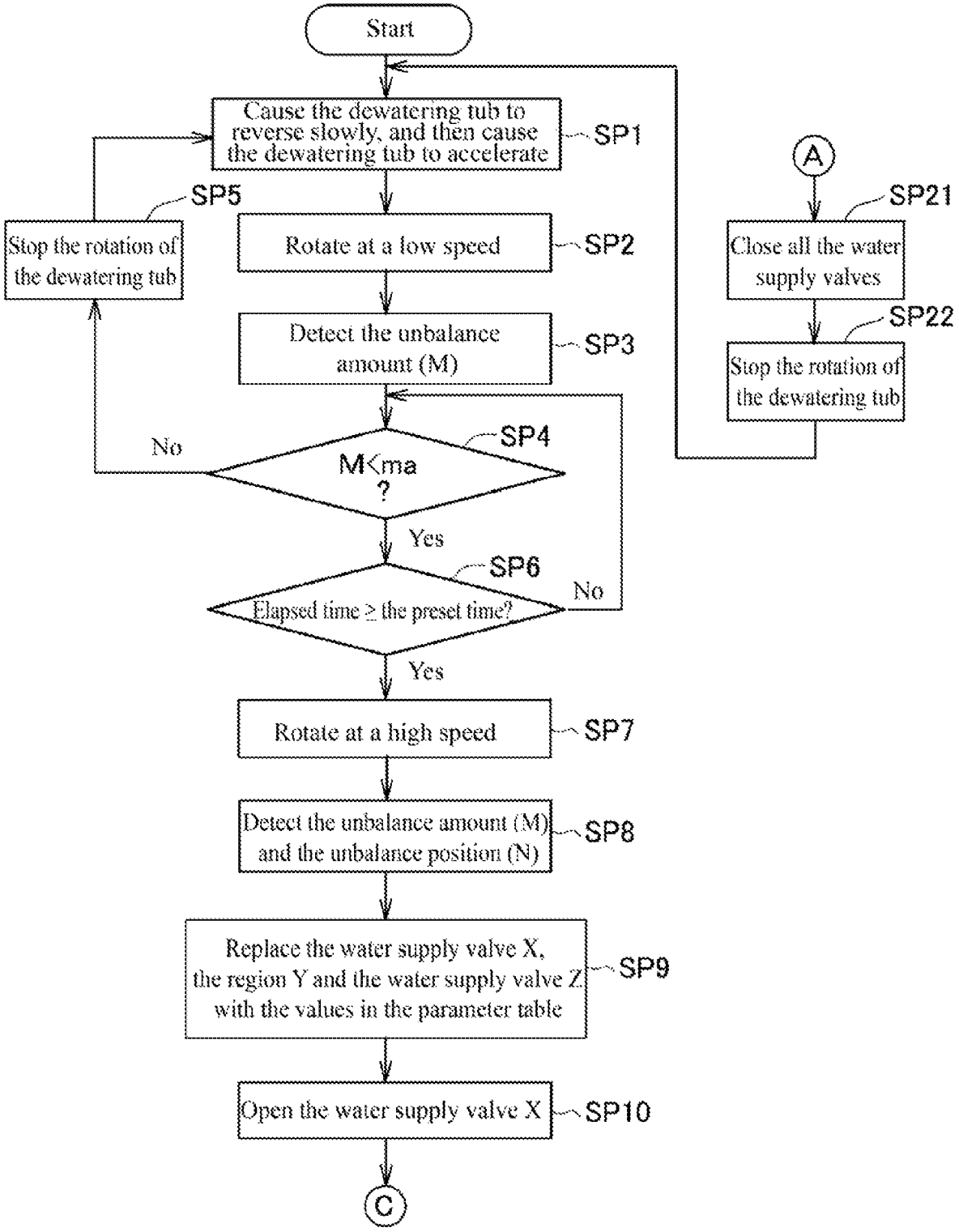
FIG. 7 is a flowchart showing a control flow during the dewatering process of the washing machine.
Figure 8:
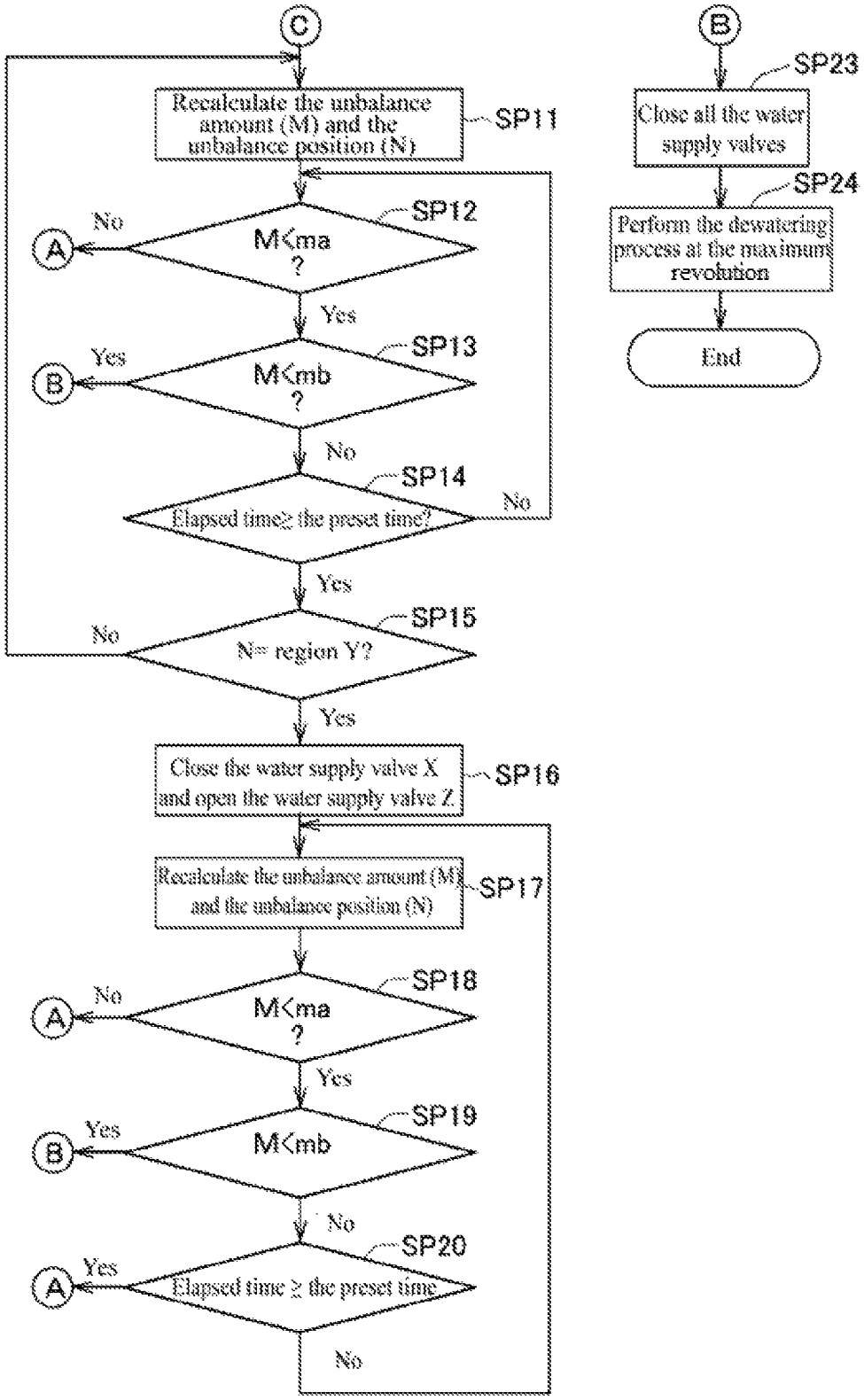
FIG. 8 is a flowchart showing a control flow during the dewatering process of the washing machine.

FIGS. 7~8 are flowcharts showing the control of the washing machine 1 according to the present embodiment.

In the present embodiment, when the central control unit 31 receives an input signal from a dewatering button (not shown) or receives a signal for activating the dewatering process during the washing mode operation, the process proceeds to step SP1 to start the dewatering process.

Step SP1

In step SP1, the central control unit 31 performs control to cause the dewatering tub 2 to reverse slowly, and then cause the dewatering tub 2 to accelerate.

Step SP2

In step SP2, the central control unit 31 performs control to rotate the dewatering tub 2 at a low speed based on the low-speed rotation setting value (N1).

Step SP3

In step SP3, the central control unit 31 performs control to detect the unbalance amount (M) based on the acceleration value (x-component of the acceleration sensor) given by the acceleration sensor 12.

Step SP4

In step SP4, the central control unit 31 performs control to compare the unbalance amount (M) with the unbalance amount setting value (ma) stored in the memory 32 to determine whether M is less than ma. When it is determined that M is less than ma, the process proceeds to step SP6. On the other hand, when it is determined that M is not less than ma, the process proceeds to step SP5. Herein, the unbalance amount setting value (ma) is a threshold value indicating that the bias of the laundry is too large to be eliminated even if the adjusting water is supplied to the baffles 7. That is, SP5 is carried out if it is determined that the bias of the laundry is too large to be eliminated even if the adjusting water is supplied to the baffles 7.

Step SP5

In step SP5, the central control unit 31 performs control to stop the rotation of the dewatering tub 2, and after that, the process returns to step SP1 to repeat steps SP1~SP4.

Step SP6

In step SP6, if the central control unit 31 determines that the time elapsed since the start of the low-speed rotation of the dewatering tub 2 is equal to or greater than a preset time for performing the low-speed rotation, the process proceeds to step SP7.

Step SP7

In step SP7, the central control unit 31 performs control based on the high-speed rotation setting value (N2) to rotate the dewatering tub 2 at a high speed.

Step SP8

In step SP8, the central control unit 31 performs control based on the acceleration value given by the acceleration sensor 12 to detect the unbalance amount (M) and the unbalance position (N).

Step SP9

In step SP9, based on the unbalance position (N), the central control unit 31 replaces the water supply valve X, the region Y and the water supply valve Z shown in FIG. 9 with the values in the parameter table. FIG. 9 is a diagram for explaining the control flows in the dewatering process of the washing machine 1. In FIG. 9, the cross section of the dewatering tub 2 is equally divided into six parts in the circumferential direction, and the positional relationship with the baffles 7 is schematically shown. The baffle 7 indicated by 7(A) is a baffle 7 to which the adjusting water is supplied from the water injection nozzle 6*a* shown in FIGS. 2 and 5. Similarly, the baffle 7 indicated by 7(B) is a baffle 7 to which the adjusting water is supplied from the water injection nozzle 6*b* shown in FIGS. 2 and 5, and the baffle 7 indicated by 7(C) is a baffle 7 to which the adjusting water is supplied from the water injection nozzle 6*c* shown in FIGS. 2 and 5.

Step SP10

In step SP10, the central control unit 31 performs control to open the water supply valve X described in the parameter table of FIG. 9. For example, when the unbalance position (N) is region I, the water supply valve X is the water supply valve 26*c* corresponding to the baffle 7(C) opposed to region I. Therefore, the adjusting water is supplied to the baffle 7 corresponding to the water supply valve X, and the amount and the position of the eccentric load change.

Step SP11

In step SP11 shown in FIG. 8, the central control unit 31 performs control to recalculate the unbalance amount (M) and the unbalance position (N) based on the acceleration value given by the acceleration sensor 12.

Step SP12

In step SP12, the central control unit 31 performs control to compare the unbalance amount (M) with the unbalance amount setting value (ma) stored in the memory 32, so as to determine whether M is less than ma. If it is determined that M is less than ma, the process proceeds to step SP13. On the other hand, if it is determined that M is not less than ma, the process proceeds to step SP21 described later. That is, if it is determined that the bias of the laundry is too large to be eliminated even if the adjusting water is supplied to the baffle 7, the process proceeds to step SP21.

Step SP13

In step SP13, the central control unit 31 performs control to compare the unbalance amount (M) with the unbalance amount setting value (mb) stored in the memory 32, so as to determine whether M is less than mb. If it is determined that M is less than mb, the process proceeds to step SP23 described later. On the other hand, when it is determined that M is not less than mb, the process proceeds to step SP14. Herein, the unbalance amount setting value (mb) is a value smaller than the unbalance amount setting value (ma), and is a threshold indicating that no noise will occur even if no adjusting water is supplied to the baffle 7 because the bias of the laundry is very little. That is, when it is determined that the eccentric load is small or absent, no noise will occur even if no water is supplied to the baffle 7, and the process proceeds to step SP23.

Step SP14

In step SP14, when the central control unit 31 determines that the time elapsed since the water supply valve X is opened is equal to or greater than a preset time, the process proceeds to step SP15. Herein, the preset time is the time required for filling one of the baffles 7 with the adjusting water.

Step SP15

In step SP15, the central control unit 31 determines whether the unbalance position (N) is the region Y shown in the parameter table of FIG. 9. If it is determined that the unbalance position (N) is the region Y, the process proceeds to step SP16. If it is determined that the unbalance position (N) is not the region Y, the process returns to step SP11. For example, if the initial unbalance position (N) in step SP11 is region I, then the unbalance position (N) is always the region I as long as no recalculation is performed, thus the process returns to step SP16. Since the result of the recalculation in step SP16 changes with time due to the water supply from the water supply valve X, the unbalance position (N) changes from the region I to the region V when the weight of the baffle 7 corresponding to the water supply valve 26*c* increases. When step SP15 is repeated for a plurality of times, the unbalance position (N) becomes the region Y.

Step SP16

In step SP16, the central control unit 31 performs control to close the water supply valve X described in the parameter table of FIG. 9 and open the water supply valve Z. For example, when the initial unbalance position (N) is the region I, the water supply valve X is the water supply valve 26*c* corresponding to the baffle 7 opposed to the region I, while the water supply valve Z is the water supply valve 26*b* corresponding to the baffle 7(B). The baffle 7(B) is located closer to the region I than the baffle 7(C) corresponding to the water supply valve 26*c*. Thus, the adjusting water is supplied to the baffle 7 corresponding to the water supply valve Z, and the amount and the position of the eccentric load change.

Step SP17

In step SP17, the central control unit 31 performs control to recalculate the unbalance amount (M) and the unbalance position (N) based on the acceleration value given by the acceleration sensor 12.

Step SP18

In step SP18, the central control unit 31 performs control to compare the unbalance amount (M) with the unbalance amount setting value (ma) stored in the memory 32, so as to determine whether M is less than ma. If it is determined that M is less than ma, the process proceeds to step SP19. On the other hand, if it is determined that M is not less than ma, the process proceeds to step SP21 described later. That is, if it is determined that the bias of the laundry is too large to be eliminated even if more adjusting water is supplied to the baffle 7, the process proceeds to step SP21.

Step SP19

In step SP19, the central control unit 31 performs control to compare the unbalance amount (M) with the unbalance amount setting value (mb) stored in the memory 32, so as to determine whether M is less than mb. If it is determined that M is less than mb, the process proceeds to step SP23 described later. That is, when it is determined that, by supplying the water to the baffle 7, the eccentric load is eliminated so that no noise occurs, the process proceeds to step SP23. On the other hand, when it is determined that M is not less than mb, the process proceeds to step SP20.

Step SP20

In step SP20, when the central control unit 31 determines that the time elapsed since the water supply valve Z is opened is equal to or greater than a preset time, the process proceeds to step SP21 described later. On the other hand, when it is determined that the time elapsed since the water supply valve Z is opened is less than the preset time, the process returns to step SP17.

Step SP21

In step SP21 shown in FIG. 7, the central control unit 31 performs control to close all of the water supply valves X, Z.

Step SP22

In step SP22, the central control unit 31 performs control to stop the rotation of the dewatering tub 2, and then the process returns to step SP1.

In this way, when it is determined that the eccentric load is too large to be eliminated even if the water is supplied to the baffle 7, the processes of steps SP21 and S22 are performed, and then the dewatering process is restarted from the beginning.

Step SP23

In step SP23 shown in FIG. 8, the central control unit 31 performs control to close all of the water supply valves X and Z.

Step SP24

In step SP24, the central control unit 31 performs control to rotate the dewatering tub 2 at the maximum revolution for a predetermined period to perform the dewatering process. Then, the dewatering process is completed.

As described above, in the present embodiment, the clothes stick to the inner peripheral surface 2*a*1 of the dewatering tub 2 by the centrifugal force, and the dewatering tub 2 is accelerated to a set rotation speed lower than the rotation speed of the dewatering rotation. At this time, the clothes are not uniformly dispersed in the dewatering tub 2, a circular orbital vibration is generated in the outer tub 3 due to the unbalance amount (M). The value of the acceleration sensor 12 is sinusoidal in accordance with the rotation of the dewatering tub 2. Based on the value of the acceleration sensor 12 when the marker 15*a* is detected by the proximity sensor 14, the microcomputer calculates the magnitude of the unbalance (M) and the angle from the position of the marker 15*a*. As long as the unbalance amount (M) detected is equal to or greater than the set value, water is injected to the baffle 7 at its symmetrical position.

The baffle 7 into which the adjusting water is injected varies depending on the unbalance position (N). First, water is only supplied to the baffle 7 which is farthest away from the initial unbalance position (N) detected and has a greater influence on the adjustment of the unbalance amount (M) and the position (N). When the supplying of water to the baffle 7 is completed, water is injected into another baffle 7 as necessary while taking into consideration changes in the unbalance amount (M) and the position (N) due to the supplying of water. Thus, as in the case of supplying water to a plurality of baffles 7 simultaneously, this eliminates the necessity of considering that the adjusting water is not supplied to each baffle 7 in a fixed amount due to the resistance of the wall surfaces of the water guiding grooves 5*a*, 5*b* and 5*c*. It is unnecessary to adjust the speed of water supplying to each baffle 7 by opening and closing the water supply valves 26*a*, 26*b*, 26*c*, so that the number of opening and closing of the water supply valves 26*a*, 26*b*, 26*c* can be reduced. Accordingly, the deterioration of durability of the water supply valves 26*a*, 26*b*, 26*c* is suppressed.

In this way, when there is an imbalance caused by the bias of the laundry in the position of X shown in FIG. 4 (*b*), water is injected into the baffle 7(A). When there is an imbalance caused by the bias of the laundry in the position of Y, water is injected into the baffle 7(B) and the baffle 7(C) while the acceleration sensor 12 monitors the decrease in acceleration and the change in the unbalance position.

Afterwards, when the unbalance amount is equal to or less than the set value, the dewatering tub 2 is accelerated to a high-speed to perform the dewatering. When the dewatering is completed and the dewatering tub 2 is decelerated, the centrifugal force is less than the gravitational acceleration, the adjusting water in the baffle 7 flows out of the lower portion from the opening 71 and is discharged.

According to the above-described dewatering operation procedure, the unbalance state of the dewatering tub 2 is detected depending on the two stages of low-speed rotation and high-speed rotation, and the unbalance state is eliminated. Therefore, the washing machine 1 capable of preventing the vibrations and noises in any processes ranging from the start to the termination of the dewatering process can be provided.

In this way, according to the method for controlling the washing machine 1 of the present disclosure, in the dewatering process, the adjusting water is injected into any one of the water guiding grooves 5*a* (5*b*, 5*c*) of the water receiving ring unit 5 from the nozzle unit 6, and is supplied to the baffle 7 via the communication member 5*a*1 (5*b*1, 5*c*1). Therefore, even if there is a bias of the laundry in the dewatering tub 2 during the dewatering process, the imbalance of the dewatering tub 2 can be eliminated while the dewatering tub 2 continues to rotate without slowing or stopping the rotation of the dewatering tub halfway. Accordingly, the vibrations and the noises caused by the eccentricity of the dewatering tub 2 can be suppressed.

As mentioned above, although one embodiment according to the present disclosure is described, the structure of the embodiment is not limited to the above structure, and various deformations can be made.

For example, in the above embodiment, the water receiving ring unit 5 is formed by three water guiding grooves 5*a*, 5*b* and 5*c*, and three baffles 7 are provided correspondingly. However, the present disclosure is not limited to this, as long as the number of the baffles 7 is set to be three or more and the number of the water guiding grooves is set to be the same as that of the baffles 7.

Further, the water receiving ring unit 5 may have a structure in which the plurality of water guiding grooves 5*a*, 5*b* and 5*c* are vertically stacked, thereby reducing the lateral width of the water receiving ring unit 5 and enlarging the opening of the dewatering tub 2.

Further, depending on the operation (condition) of the washing machine 1, the baffle 7 may have a shape that becomes widened upward or downward.

Other configurations may be modified in various ways without departing from the technical spirit of the present disclosure.

What is claimed is:

1. A washing machine, comprising:

a dewatering tub, wherein an impeller is provided at a bottom of the dewatering tub;

three or more water pipe sections, wherein the water pipe sections are arranged at equal intervals in a circumferential direction with respect to an inner circumferential surface of the dewatering tub, and are opened in the vicinity of the bottom, wherein a water circulation opening is formed at an upper end of each of the water pipe sections;

a water receiving ring unit, wherein the water receiving ring unit is fixed to an upper end of the dewatering tub and formed by stacking a plurality of annular water guiding grooves, wherein the plurality of annular water guiding grooves are connected to the upper end of respective water pipe sections via a communication member; and a nozzle unit capable of individually injecting adjusting water into each of the water guiding grooves;

wherein the communication member is connected to a position above the water circulation opening, and each of the water pipe sections is provided with a spacer extending from a position to which the communication member is connected and the water circulation opening to a position close to the inner circumferential surface of the dewatering tub.

2. The washing machine according to claim 1, wherein the water receiving ring unit is provided at the inner circumferential surface of the dewatering tub, and is formed by stacking the plurality of water guiding grooves in a radial direction of the dewatering tub.

3. The washing machine according to claim 1, wherein the water receiving ring unit is provided at the inner circumferential surface of the dewatering tub, and is formed by stacking the plurality of water guiding grooves in an up-down direction.

4. A method for controlling a washing machine, wherein the washing machine comprises: a dewatering tub, wherein an impeller is provided at a bottom of the dewatering tub; three or more water pipe sections, wherein the water pipe sections are arranged at equal intervals in a circumferential direction with respect to an inner circumferential surface of the dewatering tub, and are opened in the vicinity of the bottom, wherein a water circulation opening is formed at an upper end of each of the water pipe sections; a water receiving ring unit, wherein the water receiving ring unit is fixed to an upper end of the dewatering tub and formed by stacking a plurality of annular water guiding grooves, wherein the plurality of annular water guiding grooves are connected to the upper end of respective water pipe sections via a communication member, and a nozzle unit capable of individually injecting adjusting water into each of the water guiding grooves, the method comprising:

during a dewatering process, injecting the adjusting water into any of the water guiding grooves of the water receiving ring unit from the nozzle unit, and supplying the adjusting water to the water pipe sections via the communication member;

wherein the communication member is connected to a position above the water circulation opening, and each of the water pipe sections is provided with a spacer extending from a position to which the communication member is connected and the water circulation opening to a position close to the inner circumferential surface of the dewatering tub.

* * * * *